US008508364B2

(12) United States Patent
Nebot

(10) Patent No.: US 8,508,364 B2
(45) Date of Patent: Aug. 13, 2013

(54) METHOD AND SYSTEM FOR ENHANCING THE SAFETY OF A REGION

(75) Inventor: Eduardo Nebot, Sydney (AU)

(73) Assignee: Acumine Party Ltd (AU)

( * ) Notice: Subject to any disclaimer, the term of this patent is extended or adjusted under 35 U.S.C. 154(b) by 454 days.

(21) Appl. No.: 13/003,692

(22) PCT Filed: Jul. 11, 2008

(86) PCT No.: PCT/AU2008/001021

§ 371 (c)(1),
(2), (4) Date: Mar. 16, 2011

(87) PCT Pub. No.: WO2009/009822

PCT Pub. Date: Jan. 22, 2009

(65) Prior Publication Data

US 2011/0163877 A1 Jul. 7, 2011

(30) Foreign Application Priority Data

Jul. 13, 2007 (AU) ..... 2007903819

(51) Int. Cl.
*G08B 21/00* (2006.01)

(52) U.S. Cl.
USPC ..... 340/540; 340/690; 706/929; 706/930

(58) Field of Classification Search
USPC ..... 340/540, 573.1, 601, 690; 706/47, 706/929, 930
See application file for complete search history.

(56) References Cited

U.S. PATENT DOCUMENTS

| | | | | |
|---|---|---|---|---|
| 6,728,689 | B1 | 4/2004 | Drissi et al. | |
| 7,677,247 | B2 * | 3/2010 | Turiello | 128/205.26 |
| 8,294,568 | B2 * | 10/2012 | Barrett | 340/539.11 |
| 2006/0047543 | A1 | 3/2006 | Moses | |
| 2007/0111703 | A1 | 5/2007 | Holland et al. | |
| 2012/0128371 | A1 * | 5/2012 | Einicke et al. | 398/141 |

OTHER PUBLICATIONS

International Search Report for PCT/AU2008/001021, Completed by the Australian Patent Office on Sep. 4, 2008, 2 Pages.

* cited by examiner

*Primary Examiner* — Toan N Pham
(74) *Attorney, Agent, or Firm* — Brooks Kushman P.C.

(57) ABSTRACT

A method of enhancing the safety of a region includes defining a set of rules for the region. Collecting field data from a plurality of mobile stations movable throughout the region. The field data includes information relating to the relative movement of the mobile stations. Comparing the collected field data to the set of rules to identify one or more areas of potential risk within the region.

67 Claims, 6 Drawing Sheets

METHOD AND SYSTEM FOR ENHANCING THE SAFETY OF A REGION

FIELD OF THE INVENTION

The present invention relates to a method and system for enhancing the safety of a region.

The invention has been developed primarily for use as a method and system for enhancing the safety of hazardous regions, such as mining environments, in which the terrain, environmental conditions and equipment create areas of high risk and will be described hereinafter with reference to this application. However, it will be appreciated that the invention is not limited to this particular field of use.

BACKGROUND TO THE INVENTION

Any discussion of the prior art throughout the specification should in no way be considered as an admission that such prior art is widely known or forms part of the common general knowledge in the field.

Certain regions such as mining environments, including open-cut mines, are extremely hazardous for those operating equipment within such regions. Open-cut mines include narrow and long winding roadways for the transportation of equipment and mined material. These roadways generally do not include guard rails and have a steep drop-off or cliff-like face on one side.

These roadways are commonly unsealed such that the movement of vehicles such as haul trucks along these roadways produce large dust clouds which significantly reduce the visibility of operators of these trucks and other personnel in that region, particularly those following or approaching another vehicle.

In addition, the geographical location of many mines means they are subject to severe weather conditions including heavy rainfalls, thick fogs and smoke which again reduces the visibility in the region. Furthermore, it is common for work to take place in the darkness of night. Consequently, this reduced visibility commonly leads to accidents many of which result in serious injuries or, in the worst cases, death. Another factor contributing to accidents in mining environments is fatigue as operators are often required to work long shifts.

Some attempts have been made to reduce the number of accidents in hazardous environments. However, these systems have not adequately accounted for the diverse characteristics and risk scenarios encountered across a mining environment.

It is an object of the present invention to overcome or ameliorate one or more of the disadvantages of the prior art, or to at least provide a useful alternative.

It is an object of the invention in its preferred form to provide a method and system for enhancing the safety of a region in which the relative risk of a situation is determined and an alert reflecting this risk is generated.

SUMMARY OF THE INVENTION

According to a first aspect of the invention, there is provided a method of enhancing the safety of a region, the method including:

defining a set of rules for the region;

collecting field data from a plurality of mobile stations movable throughout the region, the field data including information relating to the relative movement of the mobile stations; and comparing the collected field data to the set of rules to identify one or more areas of potential risk within the region.

Preferably, the method includes modifying at least one rule of the set of rules to account for at least one identified area of potential risk. The method may include modifying the set of rules to account for each identified area of potential risk. The collected field data is preferably analysed using a learning algorithm such that past data is taken into account when modifying the set of rules. The learning algorithm preferably analyses the collected field data to determine whether the identified areas of potential risk are caused by a characteristic of the region or due to non-compliance with the set of rules.

The region may include a plurality of zones. Preferably, at least one of the zones is a base zone. The base zone may include a base station.

Preferably, the set of rules for the region includes zone specific rules. The set of rules is preferably stored in a database associated with the base station. The set of rules may be uploaded from the base station to a processor of each mobile station such that data collected by each mobile station can be compared to the set of rules for the region as each mobile station moves throughout the region.

Each mobile station preferably communicates (downloads) the collected field data of that mobile station to the database of the base station when that mobile station is within the base zone. Preferably, the collected field data is communicated to the database by wireless communication. The database may be used to store and analyse the collected field data. The learning algorithm is preferably stored in the database and used to analyse the collected field data to identify dangerous points and frequently occurring risky scenarios within the region or zone. Such dangerous points and risky scenarios may be caused by a characteristic of a particular zone. The set of rules may be modified or updated to account for the identified dangerous points and risky scenarios.

Preferably, each mobile station includes communication means for communicating, preferably wirelessly communicating, with the other mobile stations in the region such that data can be conveyed throughout the region. Each mobile station is preferably continuously in wireless communication with at least one other mobile station in the same zone. More preferably, each mobile station is in continuous communication with all other mobile stations in the same zone.

The data is preferably conveyed throughout the region via data hops from one mobile station to another. Preferably, one of the data hops communicates (transmits and receives) data from a mobile station in a first zone to at least one mobile station in a second zone, the mobile station in the second zone then communicating the data to at least one other mobile station in the second zone. By using data hops, any changes to the set of rules can be broadcast to all mobile stations within the region, including those mobile stations outside the base zone. In addition, data hops may allow each vehicle to receive field data from all other vehicles in the region.

The collected field data may be analysed to identify whether or not a mobile station adhered to the set of rules. The field data collected by a mobile station may include at least one of position, velocity and orientation data of that mobile station and at least one, preferably all, other mobile stations in its proximity. More preferably, the field data includes data of the relative position, velocity and orientation of other mobile stations in the same zone as the mobile station which collected that data. The mobile station in one zone may also collect data of the relative position, velocity and orientation of mobile stations in other zones.

Each identified area of potential risk preferably has an associated risk level, each risk level being determined from the comparison of the collected field data to the set of rules for the region. That is, one risk scenario may be deemed to be a high risk in one zone and a similar scenario in another zone may be deemed to be a low risk. Preferably, the method includes generating an alert which is indicative of the risk level. It will be appreciated by those skilled in the art that for certain scenarios which are identified as having a low risk level, an alert may not be generated. It will also be appreciated that this evaluation of the zone specific risk level, will reduce the occurrence of false, misleading and/or unnecessary alerts.

Preferably, each mobile station includes signal generating means for generating the alert. The alert generated by the signal generating means preferably includes a visual alert and/or an audio alert. The visual alert may include a symbol. The symbol may include a dynamic graphic. The audio alert may include sound and/or a voice command.

According to a second aspect of the invention, there is provided a safety enhancement system including:

a plurality of mobile stations, each mobile station being movable within a region;

a processor associated with each mobile station for receiving field data relating to the relative movement of the mobile stations within the region, each processor having a stored set of rules for the region against which the field data is compared to identify one or more areas of potential risk within the region.

According to a third aspect of the invention, there is provided a safety enhancement system for a region having a plurality of zones, the system including:

a plurality of mobile stations, each mobile station being movable between the plurality of zones;

communication means allowing communication of field data between each of the mobile stations that are in the same zone, the field data relating to the relative movement of the mobile stations within the region;

a processor associated with each mobile station for storing the field data communicated to that mobile station, each processor having a stored set of rules; and signal generating means for generating an alert to each mobile station based on a comparison of the field data communicated to that mobile station and the set of rules.

Again, the set of rules may be modified as the system learns from the collected field data of the risks associated with particular areas of the region or zone.

Certain embodiments of the method and systems described above may be used in a mining environment.

BRIEF DESCRIPTION OF THE DRAWINGS

A preferred embodiment of the invention will now be described, by way of example only, with reference to the accompanying drawings in which.

DETAIL DESCRIPTION OF A PREFERRED EMBODIMENT OF THE INVENTION

Figure 1:
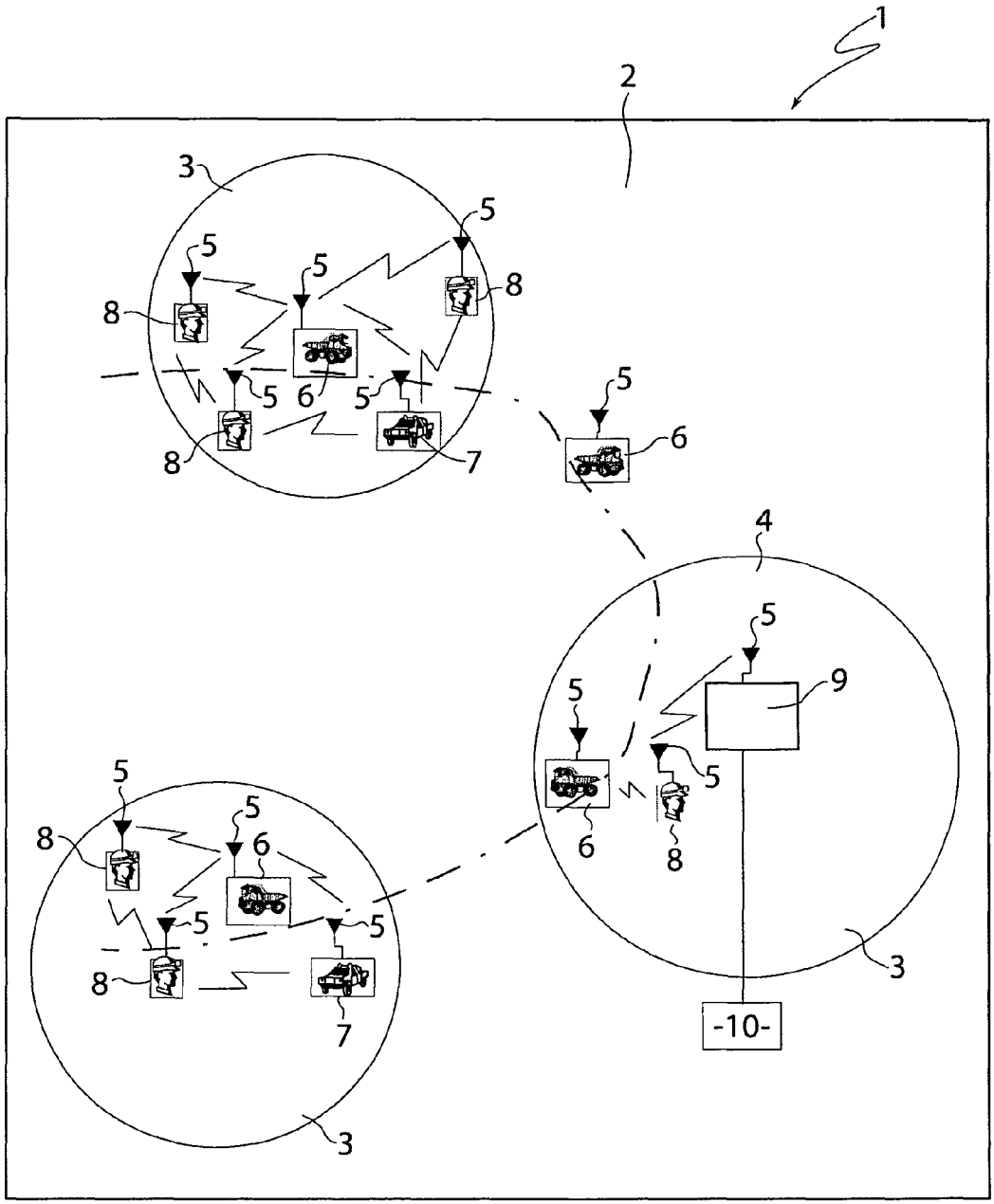
FIG. 1 is a diagrammatic view of a region having a plurality of zones in which a safety enhancement system according to the invention is implemented.
Figure 2:
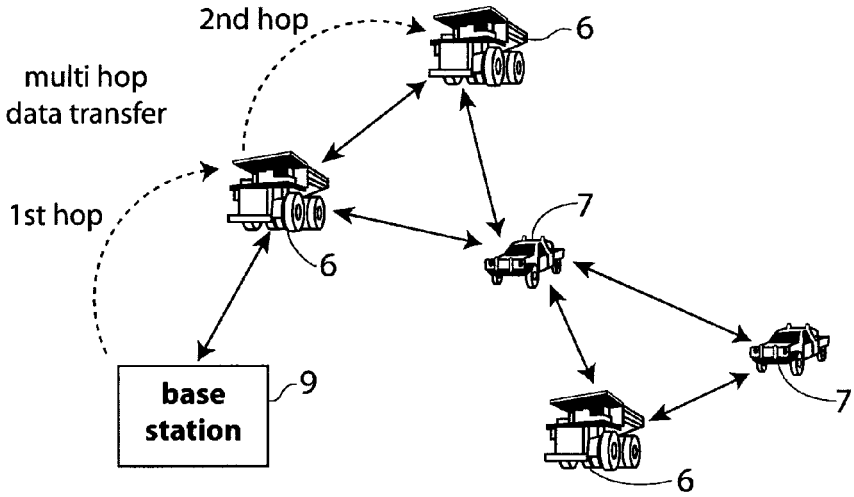
FIG. 2 is a schematic view showing communication lines between mobile stations within the region.
Figure 3:
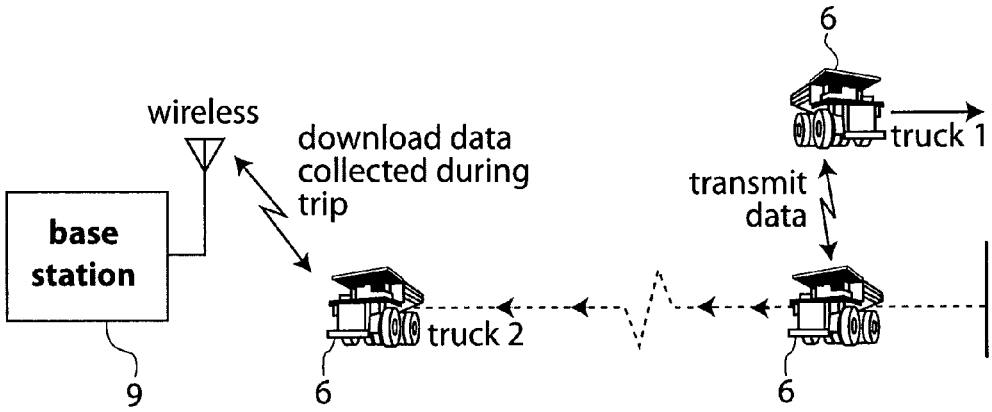
FIG. 3 is a schematic view illustrating wireless uploading and downloading of data between a base station and a mobile station.
Figure 4:
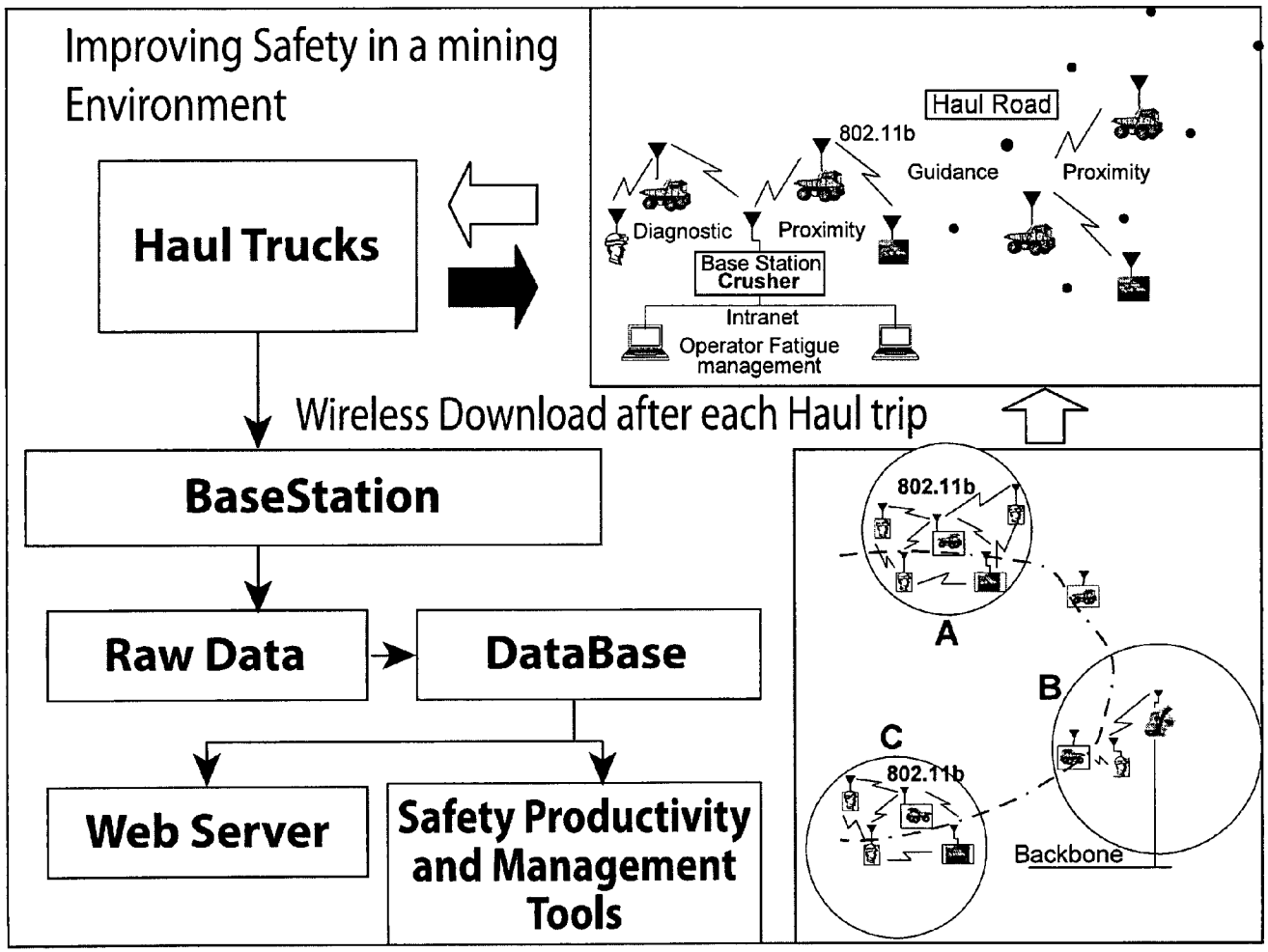
FIG. 4 is a flow chart of the process of downloading field data.
Figure 5:
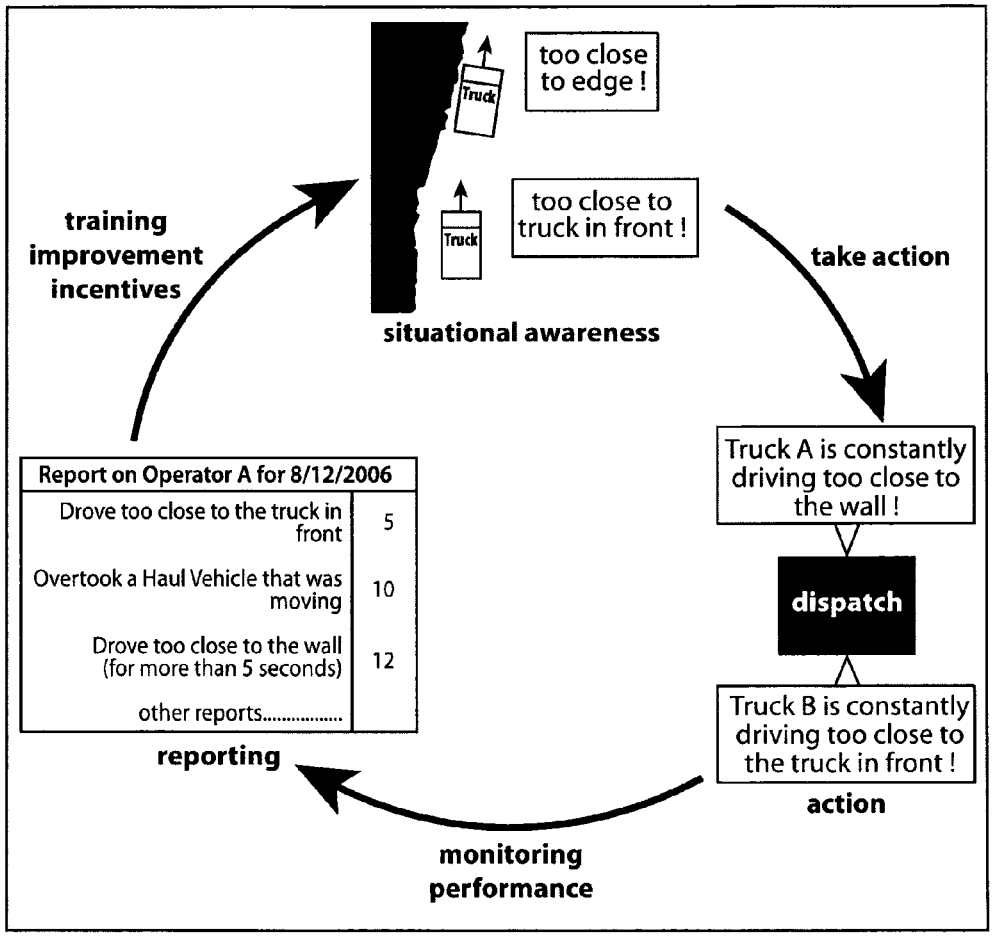
FIG. 5 is a diagrammatic view of a region the field data is used to analyse an operator's performance.
Figure 6:
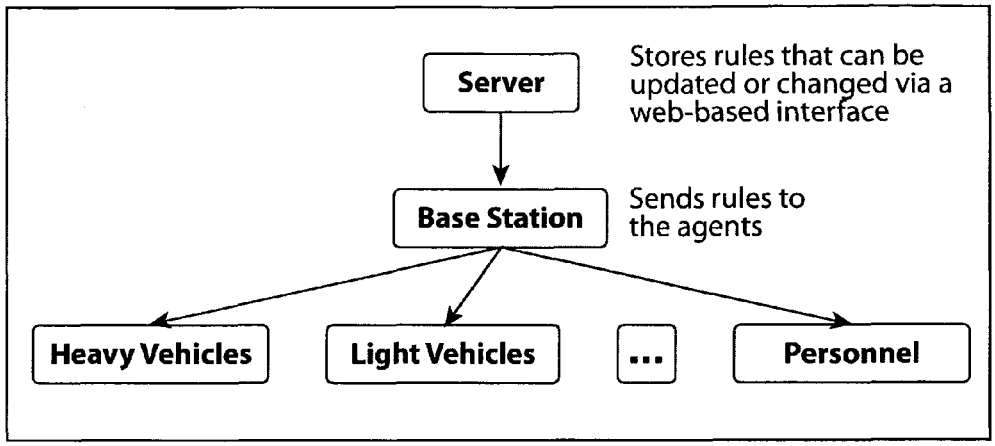
FIG. 6 is a flow chart showing the process of uploading rules for the region from a database associated with a base station and onto the mobile stations.
Figure 7:
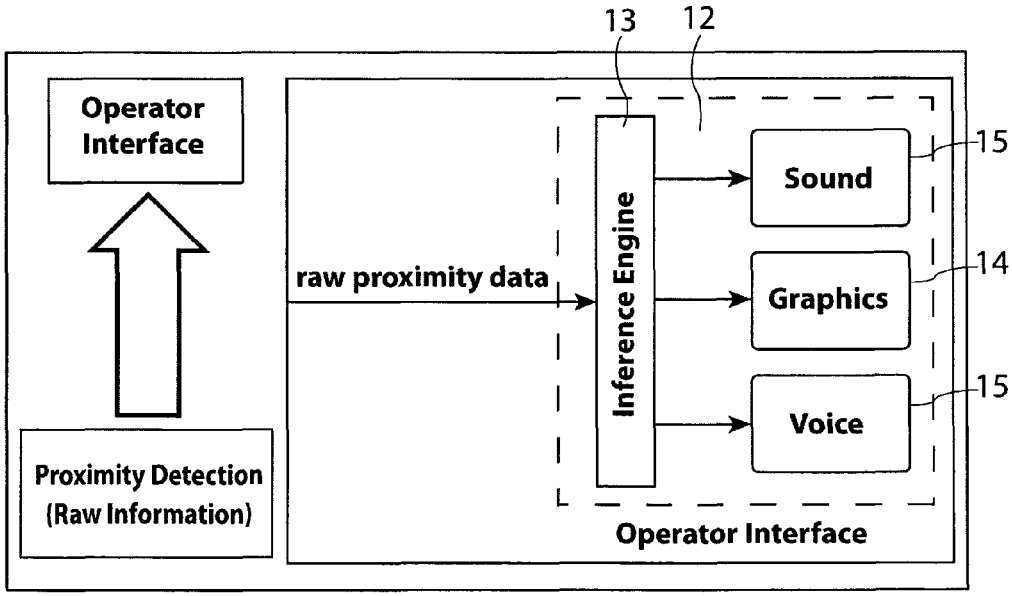
FIG. 7 is a schematic view of an operator interface for the mobile station.
Figure 8:
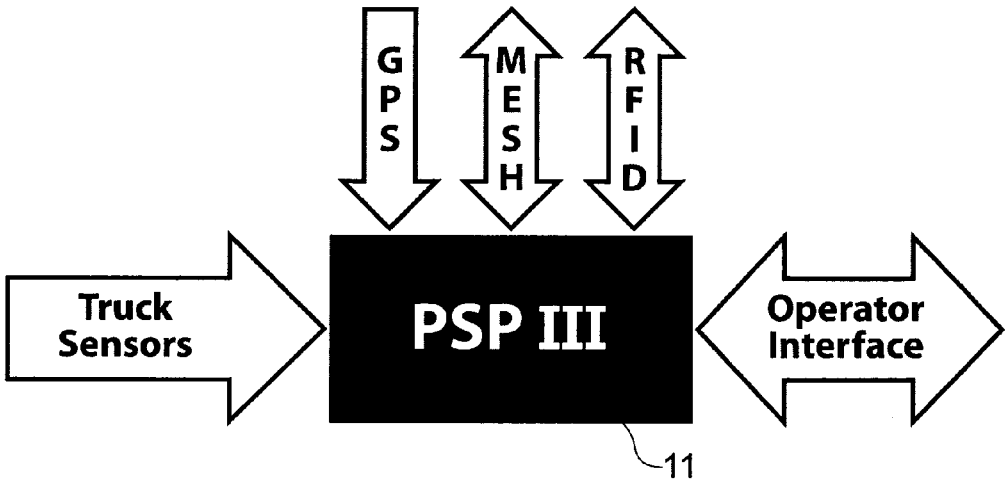
FIG. 8 is a schematic view of a signal processing box for the mobile station.
Figure 9:
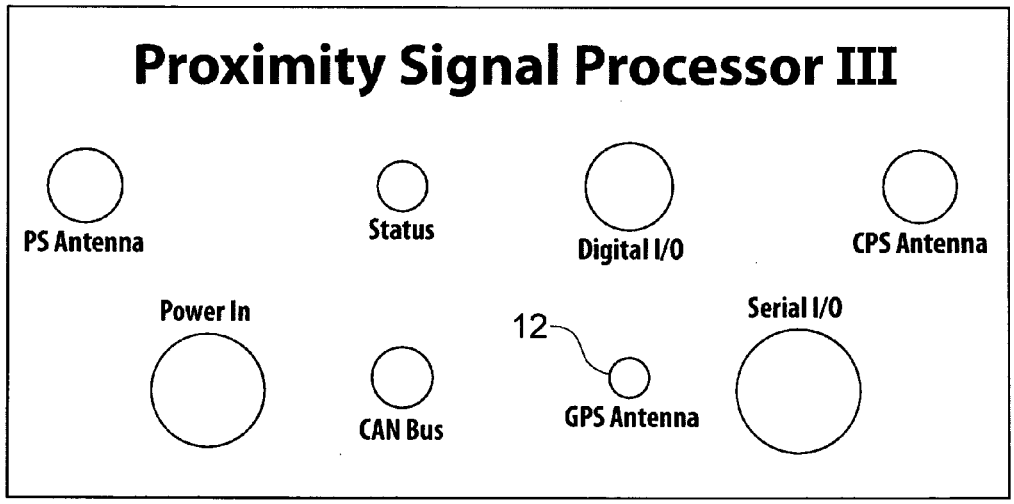
FIG. 9 is an example of a blank showing the layout of the operator interface.

Referring to the drawings, the safety enhancement system 1 is used to enhance the safety of a region such as a mine site 2. As shown in FIG. 1, the mine site 2 has a plurality of zones 3 one of which is preferably designated as a base zone 4. The base zone is preferably connected to an internal site network. A plurality of mobile stations 5 are located in or on movable objects in the form of haul trucks 6, utility vehicles or other vehicles 7 and personnel 8 which are movable throughout the mine site 2 between the zones 3. It will be appreciated that the mobile stations 5 may be associated with other forms of movable objects as well as fixed objects within the region.

The base zone 4 includes a base station 9 in communication with a database 10 which stores a set of rules for the mine site 2. These rules are established or defined by mine management or, as discussed in more detail below, the rules can be determined and refined through learning by the system before being approved by mine management. The rules govern how the operators associated with the various mobile stations 5 are to control movement of their vehicle or themselves (in the case of personnel) within each zone 3 and between the zones of the mine site 2.

Each mobile station 5 includes a signal processing box 11. The signal processing box 11 includes a processor having a memory and communication means. Each mobile station 5 includes an operator interface 12 in communication with the signal processing box 11. The signal processing box 11 interconnects with sensors and other associated sensing equipment of the associated mobile station to determine the position, velocity and other various states of that mobile station. The communication means allows data from other mobile stations 5 to be detected, collected and stored in the memory of the signal processing box 11 of that mobile station such that the relative proximity to the other mobile stations can be ascertained. The signal processing box 11 enables field data to be transmitted and received, preferably wirelessly, between the mobile stations 5 as they move throughout the mine site.

The set of rules for the region established by mine management or on the learning of the system is uploaded from the database and transmitted from the base station 9 to the mobile station 5 when the associated mobile station is in the base zone 4. The uploaded set of rules is stored in the processor of the mobile station's signal processing box 11.

As each mobile station moves throughout the region, the mobile stations 5 within the same zone transmit field data relating to their velocity, position and orientation to each of the other mobile stations within that zone 3. This data is received wirelessly via the communication means by the other mobile stations 5 within that zone 3 and stored in the associated processor of that mobile station's signal processing box 11.

The processor compares the collected field data that it has received from the other mobile stations 5 within that zone 3 with the uploaded set of rules to identify one or more areas of potential risk within the zone.

The operator interface includes a signal generating means 13 having a display 14 and an audio device 15 for producing visual and/or audio alerts to the operator of the mobile station 5. These alerts are based on the risk level determined by the processor from the comparison of the collected field data and the set of rules for the region and, in particular, the rules for that specific zone 3. In the event that the risk level is determined to be high, an appropriate alert will be generated by the signal generating means 16 such that the operator associated with that mobile station 5 will become aware that a high level risk situation is imminent.

For example, if a haul truck 6 is approaching another oncoming haul truck at a relatively high velocity the risk level may be established as being high. Similarly, if a haul truck 6 is travelling through a fog or a dust cloud where there is poor visibility and another mobile station 5 has unexpectedly parked due to a breakdown, for example, the system is able to alert the operator of the haul truck of the high risk situation arising from the parked vehicle. In contrast, if a haul truck 6 is moving through a car park in which several haul trucks or other vehicles are parked, the risk level may be determined to be low in which case a low level alert may be generated or no alert at all may be generated. Continuing with the example of the car park, if the field data establishes that there are personnel moving through the car park a high level warning may be generated to alert the operator of the haul truck to the fact that these personnel are in close proximity and that they should proceed with caution.

Accordingly, it will be appreciated that the set of rules for the region, and in particular, the zone specific rules enable the field data to be analysed to identify the context in which the data has been generated. That is, for example, in certain situations a stationary vehicle in one zone may be a normal situation and may not generate an unnecessary alarm that would cause concern to the operator. Likewise, in another zone a stationary vehicle may be considered to be a hazard such that an appropriate alert signifying the level of risk associated with this area is provided to the operator. That is, the system is able to recognise the context of a situation and generate a signal indicative of this context.

Upon return to the base zone 4, all data collected by and stored in the processor of that mobile station 5 is downloaded via wireless communication to the base station 9 and stored in the database. This downloaded data is analysed by mine management and/or the system for two purposes.

Firstly, mine management is able to use this data to identify whether or not an operator of a haul truck, for example, has operated their vehicle in a manner such that the rules of the mine site 2 were adhered to. For example, mine management will be able to determine whether or not the operator drove at excessive speed, followed too closely to the vehicle in front, drove too closely to the edge of the road and, in particular, at which locations and the number of instances in which the rules were not adhered to.

By monitoring and analysing operator performance, it can be determined whether an identified area of potential risk was caused by the characteristics of the zone in that area such that the rules should be reviewed and modified to account for these characteristics of the zone or whether the identified area of risk arose due to the operator not adhering to the rules.

Secondly, mine management is able to use the downloaded field data to identify hotspots or areas of potential risk within the region or a particular zone and modify one or more of the rules to account for each identified area of potential risk. This is advantageous as many hotspots are not known to mine management when the rules are initially set. For example, there may be particular sections of a roadway which create blind spots or otherwise require vehicles to slow down. In such situations, vehicles may inadvertently get closer to the vehicle in front and thus may not have sufficient distance to stop in the event that the leading vehicle suddenly pulls up. The set of rules will generally include rules specifying the safe travelling distance between vehicles. Accordingly, if the analysis of the collected field data uncovers that at a certain point or section of the roadway vehicles routinely travel too closely to the vehicle in front, mine management can update the set of rules to account for this area of potential risk. It will be appreciated that the learning algorithm may be used to identify an area of potential risk which arises due to the characteristics of the zone and automatically modify the set of rules.

If the rules are updated when a mobile station 4 is outside the base zone 5, a data hop is used to transmit the updated rules from a mobile station in a first zone to a mobile station in a second zone until all mobile stations have been updated. This may occur as the first mobile station moves from the first zone and enters the second zone. Instead, certain mobile stations may be able to communicate with another mobile station in another zone. In addition, these data hops also allow each vehicle to receive field data from all other vehicles in the region.

Accordingly, it is an advantage of at least a preferred embodiment of the safety enhancement system and method to track the movement of mobile stations within a region and use field data in combination with a set of rules to determine the context of a potential risk to the mobile station and thus generate warnings that reflect the actual risk level.

Although the invention has been described with reference to specific examples, it will be appreciated by those skilled in the art that the invention may be embodied in many other forms.

The invention claimed is:

1. A method of enhancing the safety of a region, the method including:

defining a set of modifiable rules for the region;

collecting field data from a plurality of mobile stations movable throughout the region, the field data including information relating to the relative movement of the mobile stations; and comparing the collected field data to the set of modifiable rules to identify one or more areas of potential risk within the region.

2. A method according to claim 1 including:

modifying at least one rule of the set of rules to account for at least one identified area of potential risk.

3. A method according to claim 2 including:

analysing the collected field data with a learning algorithm whereby past data is taken into account when modifying the set of rules.

4. A method according to claim 3 wherein the learning algorithm analyses the collected field data to determine whether the identified areas of potential risk are caused by a characteristic of the region or due to non-compliance with the set of rules.

5. A method according to claim 1 including:

modifying the set of rules to account for each identified area of potential risk.

6. A method according to claim 1 wherein the region includes a plurality of zones.

7. A method according to claim 6 wherein the set of rules for the region includes zone specific rules.

8. A method according to claim 6 wherein at least one of the plurality of zones is a base zone.

9. A method according to claim 8 wherein the base zone includes a base station.

10. A method according to claim 9 wherein the set of rules is stored in a database associated with the base station.

11. A method according to claim 10 including:

uploading the set of rules from the database to a processor of each mobile station such that data collected by each mobile station can be compared to the set of rules for the region as each mobile station moves throughout the region.

12. A method according to claim 10 including:

downloading the field data collected by each mobile station to the database associated with the base station, the field data being downloaded from a mobile station when that mobile station is within the base zone.

13. A method according to claim 12 wherein the collected field data is downloaded to the database by wireless communication.

14. A method according to claim 10 wherein the database is used to store and analyse the collected field data.

15. A method according to claim 10 wherein the learning algorithm is stored in the database.

16. A method according to claim 6 wherein each mobile station includes communication means for communicating with the other mobile stations in the region.

17. A method according to claim 16 wherein the communication means enables wireless communication between the plurality of mobile stations within the region such that data can be conveyed throughout the region.

18. A method according to claim 17 wherein the data is conveyed throughout the region via data hops from one mobile station to another.

19. A method according to claim 18 wherein one of the data hops communicates data from a mobile station in a first zone to at least one mobile station in a second zone, the mobile station in the second zone then communicating the data to at least one other mobile station in the second zone.

20. A method according to claim 19 wherein each mobile station is in continuous wireless communication with at least one other mobile station in the same zone.

21. A method according to claim 20 wherein each mobile station is in continuous communication with all other mobile stations in the same zone.

22. A method according to claim 18 including:

using the data hops to communicate any modifications to the set of rules for the region to all mobile stations within the region.

23. A method according to claim 1 including:

analysing the collected field data to identify whether or not a mobile station adhered to the set of rules.

24. A method according to claim 1 wherein the field data collected by a mobile station includes at least one of position data, velocity data and orientation data of that mobile station.

25. A method according to claim 24 wherein the field data collected by the mobile station also includes data from at least one other mobile station within the region.

26. A method according to claim 25 wherein the field data collected by the mobile station includes at least one of position data, velocity data and orientation data of that mobile station and all other mobile stations in the region.

27. A method according to claim 1 wherein each area of potential risk has an associated risk level, each risk level being determined from the comparison of the collected field data to the set of rules for the region.

28. A method according to claim 27 including:

generating an alert which is indicative of the risk level.

29. A method according to claim 28 wherein each mobile station includes signal generating means for generating the alert.

30. A method according to claim 28 wherein the alert includes a visual alert and/or an audio alert.

31. A method according to claim 30 wherein the visual alert includes a symbol.

32. A method according to claim 31 wherein the symbol includes a dynamic graphic.

33. A method according claim 30 wherein the audio alert includes a voice command.

34. A safety enhancement system including:

a plurality of mobile stations, each mobile station being movable within a region;

a processor associated with each mobile station for receiving field data relating to the relative movement of the mobile stations within the region, each processor having a stored set of modifiable rules for the region against which the field data is compared to identify one or more areas of potential risk within the region.

35. A safety enhancement system according to claim 34 in which at least one rule of the set of rules is modified to account for at least one identified area of potential risk.

36. A safety enhancement system according to any claim 35 in which the field data is analysed with a learning algorithm such that past data is taken into account when modifying the set of rules.

37. A safety enhancement system according to claim 36 in which the learning algorithm analyses the collected field data to determine whether the identified areas of potential risk are caused by a characteristic of the region or due to non-compliance with the set of rules.

38. A safety enhancement system according to claim 34 in which the set of rules is modified to account for each identified area of potential risk.

39. A safety enhancement system according to claim 34 in which the region includes a plurality of zones.

40. A safety enhancement system according to claim 39 in which the set of rules for the region includes zone specific rules.

41. A safety enhancement system according to claim 39 in which at least one of the plurality of zones is a base zone.

42. A safety enhancement system according to claim 41 in which the base zone includes a base station.

43. A safety enhancement system according to claim 42 in which the set of rules is stored in a database associated with the base station.

44. A safety enhancement system according to claim 43 in which the set of rules is uploaded from the database to the processor of each mobile station.

45. A safety enhancement system according to claim 43 in which the field data received by each mobile station is downloaded to the database associated with the base station, the field data being downloaded from a mobile station when that mobile station is within the base zone.

46. A safety enhancement system according to claim 45 in which the field data is downloaded to the database by wireless communication.

47. A safety enhancement system according to claim 43 in which the database is used to store and analyse the collected field data.

48. A safety enhancement system according to claim 43 in which the learning algorithm is stored in the database.

49. A safety enhancement system according to claim 39 in which each mobile station includes communication means for communicating with the other mobile stations in the region.

50. A safety enhancement system according to claim 49 in which the communication means enables wireless communication between the plurality of mobile stations within the region such that data can be conveyed throughout the region.

51. A safety enhancement system according to claim 50 in which the data is conveyed throughout the region via data hops from one mobile station to another.

52. A safety enhancement system according to claim 51 in which one of the data hops communicates data from a mobile station in a first zone to at least one mobile station in a second zone, the mobile station in the second zone then communicating the data to at least one other mobile station in the second zone.

53. A safety enhancement system according to claim 52 in which each mobile station is in continuous wireless communication with at least one other mobile station in the same zone.

54. A safety enhancement system according to claim 53 in which each mobile station is in continuous communication with all other mobile stations in the same zone.

55. A safety enhancement system according to claim 51 in which the data hops are used to communicate any modifications to the set of rules for the region to all mobile stations within the region.

56. A safety enhancement system according to claim 34 in which the field data is analysed to identify whether or not a mobile station adhered to the set of rules.

57. A safety enhancement system according to claim 34 in which the field data received by a mobile station includes at least one of position data, velocity data and orientation data of that mobile station.

58. A safety enhancement system according to claim 57 in which the field data received by the mobile station also includes data from at least one other mobile station within the region.

59. A safety enhancement system according to claim 58 in which the field data collected by the mobile station includes at least one of position data, velocity data and orientation data of that mobile station and all other mobile stations in the region.

60. A safety enhancement system according to claim 34 in which each area of potential risk has an associated risk level, each risk level being determined from the comparison of the field data to the set of rules for the region.

61. A safety enhancement system according to claim 60 in which an alert is generated, the alert being indicative of the risk level.

62. A safety enhancement system according to claim 61 in which each mobile station includes signal generating means for generating the alert.

63. A safety enhancement system according to claim 61 in which the alert includes a visual alert and/or an audio alert.

64. A safety enhancement system according to claim 63 in which the visual alert includes a symbol.

65. A safety enhancement system according to claim 64 in which the symbol includes a dynamic graphic.

66. A safety enhancement system according to claim 63 in which the audio alert includes a voice command.

67. A safety enhancement system for a region having a plurality of zones, the system including:

a plurality of mobile stations, each mobile station being movable between the plurality of zones;

communication means allowing communication of field data between each of the mobile stations that are in the same zone, the field data relating to the relative movement of the mobile stations within the region;

a processor associated with each mobile station for storing the field data communicated to that mobile station, each processor having a stored set of modifiable rules; and signal generating means for generating an alert to each mobile station based on a comparison of the field data communicated to that mobile station and the set of modifiable rules.

* * * * *